US006835108B1

(12) United States Patent
Gieseke

(10) Patent No.: US 6,835,108 B1
(45) Date of Patent: Dec. 28, 2004

(54) OSCILLATING APPENDAGE FOR FIN PROPULSION

(75) Inventor: Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/758,748

(22) Filed: Jan. 12, 2004

(51) Int. Cl.[7] ..... B63H 1/36
(52) U.S. Cl. ..... 440/14
(58) Field of Search ..... 440/13–15

(56) References Cited

U.S. PATENT DOCUMENTS

| | | | | |
|---|---|---|---|---|
| 3,385,253 A | * | 5/1968 | Mathey | 440/86 |
| 4,389,196 A | | 6/1983 | Gander | |
| 4,941,627 A | | 7/1990 | Moscrip | |
| 5,366,395 A | | 11/1994 | Mostaghel et al. | |
| 5,401,196 A | | 3/1995 | Triantafyllou et al. | |
| 5,740,750 A | * | 4/1998 | Triantafyllou et al. | 114/67 R |
| 6,089,178 A | | 7/2000 | Yamamoto et al. | |
| 6,138,604 A | * | 10/2000 | Anderson et al. | 114/332 |
| 6,500,033 B1 | | 12/2002 | Sagov | |

OTHER PUBLICATIONS

Michael H. Dickinson et al, Wing Rotation and the Aerodynamic Basis of Insect Flight, SCIENCE, Jun. 18, 1999, pp. 1954–1960, vol. 284, American Association for the Advancement of Science, Washington, DC.

Promode R. Bandyopadhyay, Maneuvering Hydrodynamic of Fish and Small Underwater Vehicles, Integrative and Comparative Biology, Feb. 2002, pp. 102–117, vol. 42, No. 1, Society for Integrative and Comparative Biology, WA.

* cited by examiner

*Primary Examiner*—Jesus D. Sotelo
(74) *Attorney, Agent, or Firm*—James M. Kasischke; Michael P. Stanley; Jean-Paul Nasser

(57) ABSTRACT

An oscillating appendage includes a vessel housing a supply of pressurized fluid with reinforced tubes selectively receiving the pressurized fluid from the vessel, an oscillating valve for controlling the supply of pressurized fluid from the vessel to the reinforced tubes, and a flexible skin encompassing the vessel, the reinforced tubes, and the valve. The flexible skin defines an outer shape of the oscillating appendage with a tail member affixed at a terminal end of the appendage to further propel the appendage by an oscillating motion of the appendage.

14 Claims, 2 Drawing Sheets

OSCILLATING APPENDAGE FOR FIN PROPULSION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a device for generating an oscillating motion from a flexible appendage.

(2) Description of the Prior Art

The current art for compact propulsion systems is varied. Some current concepts for unmanned undersea vehicles are very small and simple vehicles which operate in swarms. Each vehicle contains a small sensor which in itself is not particularly powerful but when combined with the sensors from many other vehicles provides a powerful sensing capability.

For a very small vehicle to be feasible, it must include space-efficient and weight-efficient energy storage, energy conversion and propulsion systems. Conventional systems utilize batteries, motors, and propellers for energy storage, energy conversion and propulsion systems, respectively. These systems can be very efficient but have limited power densities. Also, if engineered for performance, the systems can be very expensive and can involve many components which could fail under extended operation.

An alternative to the use of propellers is the use of flapping wing-like devices. It has been shown that dynamically-pitching foils can produce many times the lift compared to static foils with the same dimensions.

Triantafyllou et al. (U.S. Pat. No. 5,401,196) has shown that an optimal oscillation frequency exists which maximizes the lift produced by simple flapping wings.

In the Bandyopadhyay reference, "Maneuvering Hydrodynamics of Fish and Small Underwater Vehicles" INTEGRATIVE AND COMPARITIVE BIOLOGY, February 2002-Vol. 42, it has been further shown that the nature of vortex production from flapping foils controls the efficiency of wings as propulsive devices.

Further, in the Dickinson reference, "Wing Rotation and the Aerodynamic Basis of Insect Flight" SCIENCE, 18 Jun. 1999-Vol 284, it has been shown that the circulation of wings is critical to the enhanced lift production with a low Reynolds number for insect flight.

A number of devices have been proposed which attempt to take advantage of the hydrodynamic effects associated with the flapping foil motion commonly seen in fish propulsion and bird flight. However, it is not readily evident that any device has been proposed which is mechanically simple and can be manufactured in quantity at a very low cost.

The following patents, for example, disclose types of oscillatory wing devices, but do not disclose a device which produces an oscillatory motion in a flexible appendage, which utilizes pressurized fluid to inflate specially designed tubes within the appendage, and which includes a valve system for automatically distributing the pressurized fluid to the appropriate tubes.

Specifically, Gander (U.S. Pat. No. 4,389,196) discloses a watercraft, propelled by a swivellable propulsion fin, in which the fin extends from its swivel axle parallel to the longitudinal direction of the watercraft and which is swivellable laterally by a drive device. The swivellable propulsion fin is arranged on the stern of the watercraft in the prolongation thereof.

Moscrip (U.S. Pat. No. 4,941,627) discloses a hollow fin with a rhombical cross-section constructed of Nitinol or another memory effect alloy, mounted for oscillation about an internal shaft. The memory effect alloy has been previously stretched at a temperature below its critical transition temperature such that heating of one pair of opposite sides, in a rhombic sense, above the critical transition temperature by resistive dissipation of an electric current will cause shortening of this pair of sides and consequent change in the angle of attack.

Mostaghel et al. (U.S. Pat. No. 5,366,395) discloses a pulsating impeller system moving a body through a fluid medium. The pulsating impeller includes an enclosure mounted on a vessel or other body. The enclosure is provided with an inlet-outlet aperture for the flow of the fluid medium into and out of the enclosure. An expandable membrane is positioned in the enclosure. The volume of the membrane is inflated and deflated on a regular cycle by a compressed air or similar system in the vessel. When the enclosure is placed in a fluid such as water, and the membrane inside the enclosure is inflated and the volume of the membrane is increased, which results in the water being forced through the outlet hole in the enclosure to propel the vessel. This force generates a reactive force which thrusts the enclosure and vessel in the opposite direction.

Triantafyllou et al. (U.S. Pat. No. 5,401,196) discloses a propulsion system for use in a fluid, the system utilizing at least one foil which is both oscillated at a frequency "f" with an amplitude "a" in a direction substantially transverse to the propulsion direction and flapped or pitched about a pivot point to change the foil pitch angle to the selected direction of motion with a smooth periodic motion. Parameters of the system including Strouhal number, angle of attack, ratio of the distance to the foil pivot point from the leading edge of the foil to the chord length, the ratio of the amplitude of oscillation to the foil chord width and the phase angle between heave and pitch are all selected so as to optimize the drive efficiency of the foil system.

Yamamoto et al. (U.S. Pat. No. 6,089,178) discloses a submersible vehicle having swinging wings. The vehicle is provided with a main body and rotatable shafts arranged in series and located at front edges of the swinging wings, actuators for driving the shafts independently of one another, and a wing controller for controlling the actuators in such a manner that the wings swing in a flexible manner like the tail fin of a fish.

Sagov (U.S. Pat. No. 6,500,033) discloses a method for propulsion of water-going vessels comprising a plate, which is located in the water and extends across a desired direction of motion for the vessel, where the plate is moved from a first position to a second position and back. Under the influence of a motive force the extent of which varies sinusoidally, the plate is brought into translatory and rectilinear oscillation about a neutral position between the first and the second position, the neutral position being determined by a static equilibrium between spring forces influencing the plate. The plate is controlled in such a manner that its plane extends perpendicularly to the vessel's direction of motion, and greater resistance is exerted by the plate against the water when it is moved opposite to the vessel's desired direction of motion than when it is moved in this direction.

It should be understood that the present invention would in fact enhance the functionality of the above references by providing an oscillating motion by a flexible appendage, the flexible appendage including specially designed tubes embedded therein, and the tubes being manipulated with a supply of pressurized fluid.

SUMMARY OF THE INVENTION

Accordingly, it is a general purpose and primary object of the present invention to provide a device as an oscillating appendage for fin propulsion.

It is therefore a further object of this invention to provide an oscillating appendage with motion as the result of action by pressurized fluid.

It is therefore a still further object of the present invention to provide an oscillating appendage in which a selector valve alternates a supply of pressurized fluid to a selected portion of the appendage.

In accordance with one aspect of the present invention, there is provided an oscillating appendage including a pressure vessel housing a supply of pressurized fluid, reinforced tubes selectively receiving fluid pressure from the pressure vessel, a valve for controlling the supply of pressurized fluid from the pressure vessel to the reinforced tubes, and a flexible skin encompassing the pressure vessel, the reinforced tubes, and the valve. The flexible skin defines an outer shape of the oscillating appendage and a tail member is affixed at a terminal end of the oscillating appendage to propel the appendage when the appendage oscillates. The valve is operated to supply pressure to one or the other of the reinforced tubes, thereby selectively directing the movement of the appendage.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
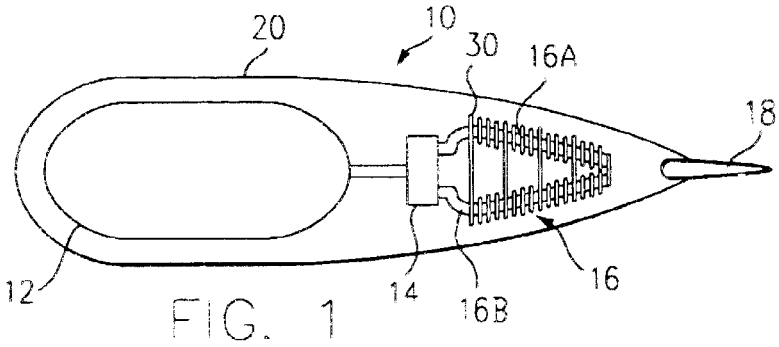
FIG. 1 depicts a top cross-sectional view of a flexible appendage according to a preferred embodiment of the present invention with the appendage in a neutral position.
Figure 2:
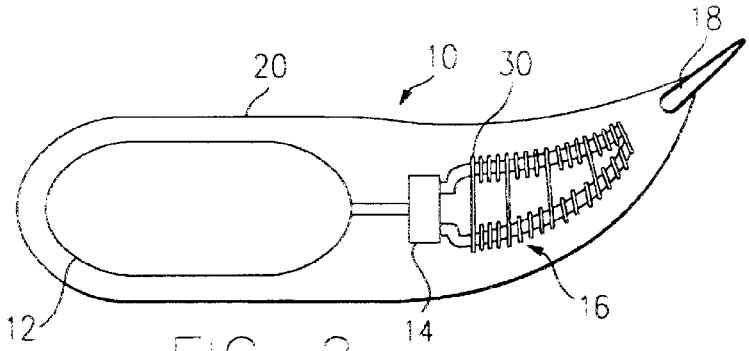
FIG. 2 depicts a top cross-sectional view of the flexible appendage of the present invention with the appendage in a flexed position.
Figure 3:
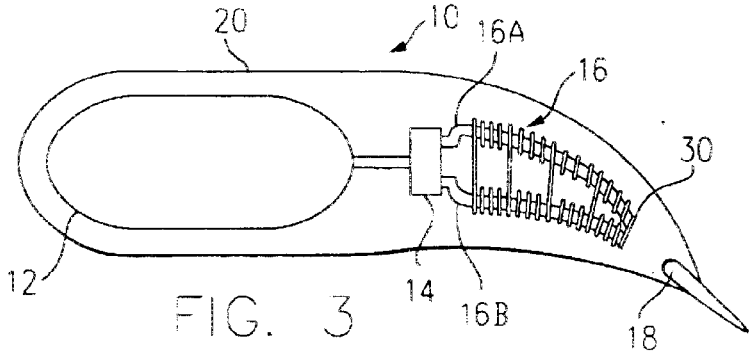
FIG. 3 depicts a top cross-sectional view of the flexible appendage of the present invention with the appendage in an opposing flexed position.

In general, the present invention is directed to a propulsion device in which the propulsion is created by an oscillatory motion in a flexible appendage. Such a flexible appendage 10 is generally shown in FIGS. 1, 2 and 3 in neutral and opposingly flexed positions.

Specifically, the flexible appendage 10 includes a pressure vessel 12 which contains pressurized gas or fluid as a system driver for the flexible appendage. A valve 14 distributes pressurized fluid from the fluid supply in the pressure vessel 12 to reinforced tubes 16. The valve 14 can be externally controlled to distribute fluid through a fluid system of the appendage 10 as desired, or it can be automatic, to distribute fluid in a predetermined fashion. As will be further described, an automatic mechanical system is proposed for simplicity with the detail of the valve 14 further described in connection with FIG. 4.

A plurality of reinforced tubes 16 extend from the valve 14 to a tail 18 of the appendage 10. The reinforced tubes 16 are shown in detail in FIG. 5 and will be further described below for their structure and operation.

A spongy and flexible skin 20 is wrapped around the reinforced tubes 16, the pressure vessel 12, and the valve 14 to create a body and transmit the movement of the flexible appendage 10. The skin 20 of a type known to those skilled in the art can easily be compressed and stretched during articulation of the appendage 10.

Figure 5:
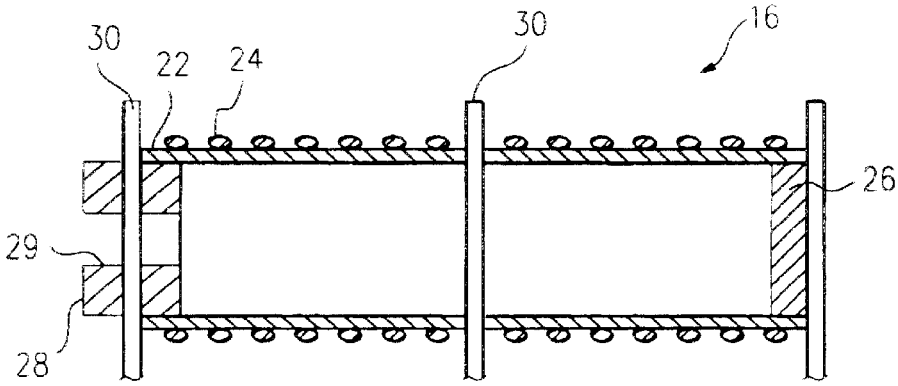
FIG. 5 is a sectional view of a reinforced tube for use in the present invention.

Referring to the reinforced tube 16 shown in FIG. 5, the tube includes an inner elastomeric tube 22 which holds pressure and allows axial expansion of the tube. Rigid constraint rings 24 spaced along the tube 16 prevent radial expansion of the inner tube 22. Ideally, the constraint rings 24 are thin and closely spaced to prevent herniation of the inner elastomeric tube 22. An end cap 26 closes the end of the inner elastomeric tube 22 and transfers internal pressure to axial tube loading. A combined supply port/end cap 28 closes an opposing end of the inner elastomeric tube 22, transfers internal pressure to axial tube loading, and allows pressurized fluid to enter the tube structure 16 by an opening 29 in the supply port/end cap. Interconnecting members 30 connect one tube 16 to others and/or to a structure so that axial expansion of the tube is transferred into driving motions.

Figure 4:
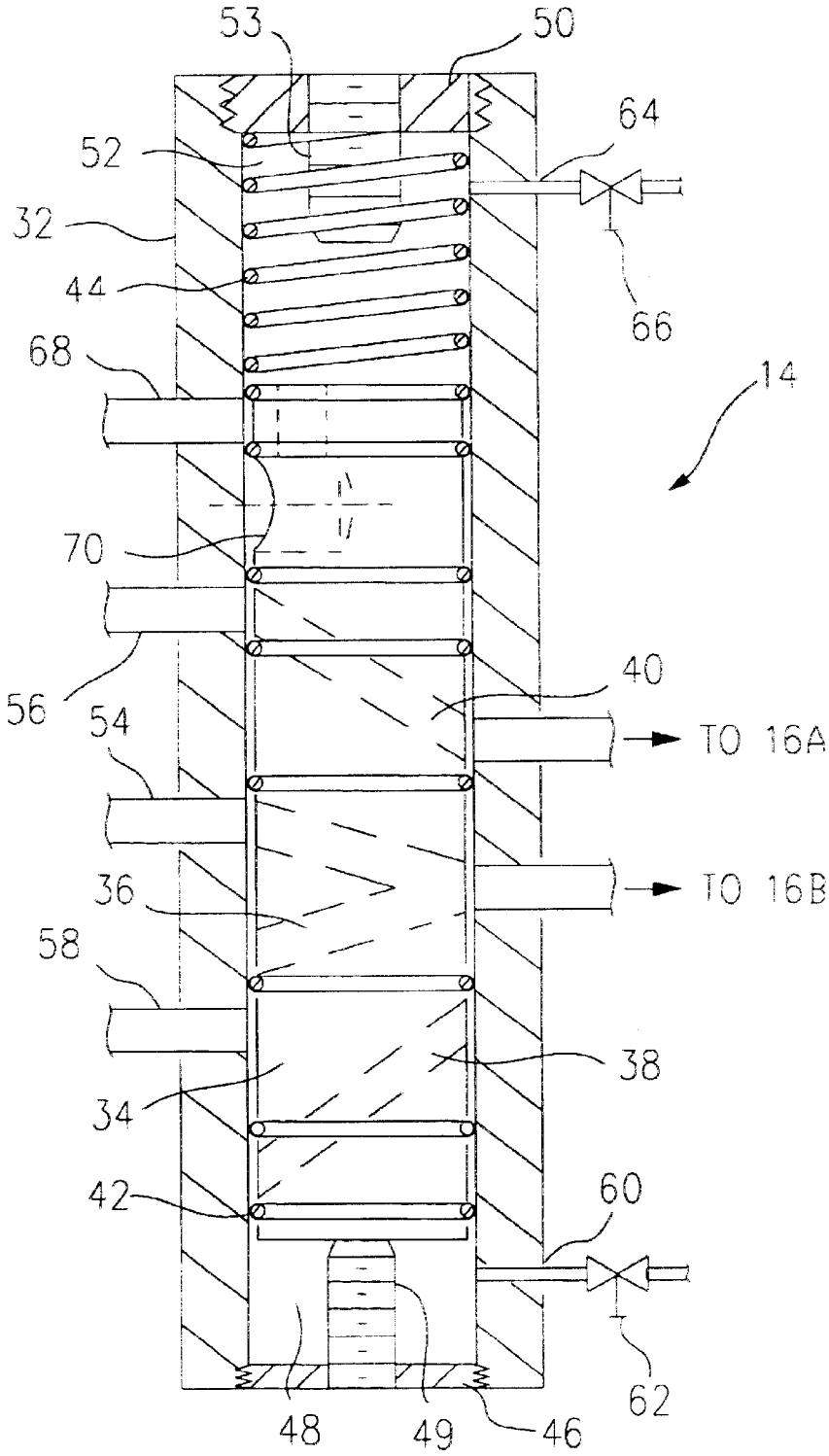
FIG. 4 is a sectional view of a valve for use in the flexible appendage of the present invention.

Turning now to the oscillating valve 14 shown in detail in FIG. 4, the valve generally includes a casing 32 which houses a spindle 34. The casing 32 also attaches to pressure lines and includes chambers 48, 52 on opposite sides of the spindle 34.

The spindle 34 is cylindrically shaped having pass-through lines 36, 38, and 40 formed therein to connect pressures and vents to tubes 16A and 16B. Multiple circumferential seals 42, such as O-rings, are provided to prevent fluid flow from one tube 16A to another tube 16B. A spring member 44 normally biases the spindle 34 to the chamber 48. In other words, when the spindle 34 is fully seated to the chamber 48, the spring 44 maintains a force to the chamber due to its preload.

A first stop/end-cap 46 closes the pressure chamber 48 and includes a stem 49 for terminating motion of the spindle 34.

A second stop/end cap 50 closes the pressure chamber 52 and includes a stem 53 for terminating motion of the spindle 34. The first stop/end cap 46 and second stop/end cap 50 may be threaded into an opening in the respective ends of the casing 32 in order to provide a secure fitting therewith.

Pressurized fluid is supplied from the pressure vessel 12 to the valve 14 through a supply port 54.

First vent port 58 connects the tube 16B to ambient pressure when the spindle 34 is fully to the pressure chamber 52. A second vent port 56 connects the tube 16A to ambient pressure when the spindle 34 is fully to the pressure chamber 48.

A pressurization port 60 connects the pressure chamber 48 to a pressurization throttle 62. A pressurization port 64 connects the pressure chamber 52 to a pressurization throttle 66.

The pressurization throttle 62 restricts flow from the tube 16B to the pressure chamber 48. More restriction increases the time required to build sufficient pressure in the pressure chamber 48 to force the spindle 34 to the pressure chamber 52.

The pressurization throttle 66 restricts flow from the tube 16B to the pressure chamber 52. More restriction decreases the time required to build sufficient pressure in the pressure chamber 48 to force the spindle 34 to the pressure chamber 52. If insufficient restriction is provided from the throttle 66, pressure from the pressure chamber 52 will build too quickly and insufficient pressure will be available to force the spindle 34 toward the pressure chamber 52.

A vent port 68 allows air or fluid built up in the pressure chamber 52 to be quickly vented once motion to the chamber is initiated.

A vent passage 70 allows the flow of air or fluid for the pressure chamber 52 through the vent port 68.

The vent pass-through line 38 acting as a vent, connects the tube 16B to ambient pressure when the spindle 34 is toward the pressure chamber 52. The vent pass-through line 40, also acting as a vent, connects the tube 16A to ambient pressure when the spindle 34 is toward the pressure chamber 48. The pass-through line 36 acting as a fluid supply connects the tube 16A or the tube 16B to supply pressure when the spindle 34 is positioned toward the pressure chambers 52 and 48, respectively.

Thus, a mechanical device is proposed for the fluid distribution control. Its design generates an oscillating motion of the spindle 34 alternately connecting the tube 16B and tube 16A with pressurized fluid. When the system is de-energized, all volumes, lines and chambers are filled with ambient pressure fluid. The spindle 34 is forced to the chamber 48 against the stem 49 of the end cap 46 by the preloaded spring 44.

To start oscillation of the flexible appendage 10, pressurized fluid is supplied to the supply port 54 and flows through the valve 14 to the tube 16B. As the pressure builds in the tube 16B, the tube expands axially, forcing the tail to bend as shown in FIG. 2. The tube 16B is connected to both ports 60, 64 through the pressurization throttles 62, 66, respectively. The throttles 62, 66 regulate the flow of fluid into the pressure chambers 48, 52. Fluid flow at the chamber 52 is restricted more than fluid flow at the chamber 48 so that pressure builds faster at the chamber 48. When the net force of the spindle 34 through the pressure difference on the sides of the spindle exceeds the preload of the spring 44, the spindle begins to move to the chamber 52. After a very short motion, the vent port 68 is opened and the fluid within the pressure chamber 52 is free to escape. The pressure forces then grow, forcing the spindle 34 completely to the pressure chamber 52. The tube 16B is then connected to ambient pressure through the pass-through line 38 and the tube 16A is connected to the pressure vessel 12 through the pass-through line 36.

As the pressure drops in the pressure chamber 48 and pressure increases in the pressure chamber 52, the tube 16A expands and the tube 16B contracts forcing the tail 18 to bend as shown in FIG. 3. Simultaneously, the pressure of the tube 16B drops below the pressure of the pressure chamber 48 and pressure is released back through the pressurization throttle 62. When the pressure drops below the preload of the spring 44 forcing the spindle 34 to the pressure chamber 48, the spindle moves back to the pressure chamber 48. As the spindle 34 moves, the tube 16A is connected to ambient pressure, vents and contracts while the tube 16B connects to the pressurized fluid of the pressure vessel 12, pressurizing and expanding. The vent passage 70 reseals and air is forced from the tube 16B back into the sides of the spindle 34, initiating the cycle again.

The frequency of system oscillation is controlled by the settings of the pressurization throttles 62, 66. Throttles remaining wide open allow the air to rapidly pressurize the sides of the spindle 34 and the device oscillates rapidly. Restricted flow slows the dynamics of the valve 14. In addition, residence time of the spindle 34 in its positions can be controlled by adjusting the spring preload, stiffness, and the throttle settings.

Although the valve 14 can be connected to conventional linear actuators, pneumatic motors, or other devices, to support the preferred embodiment, motion of the flexible appendage 10 is generated through the use of the circumferentially reinforced elastomeric tubes 22. The tubes are described in detail in U.S. Pat. No. 6,148,713 "Elastomeric Surface Actuation System", incorporated herein by reference.

The thin walled elastomeric tube 22 is surrounded by the constraint rings 24. When fluid is forced through the supply port in the end cap 28, internal pressure forces the end caps 26, 28 axially and the tube 22 radially. Because expansion is constrained radially by the constraint rings 24, the tube 22 expands in an axial direction only. If the constraint rings 24 are closely spaced, the elastomeric tube 22 cannot form a hernia between the constraint rings and the system remains stable. Two of the reinforcing tubes connected together with the interconnecting members 30 can form the articulation system necessary to oscillate the tail 18.

In view of the above detailed description, it is anticipated that the invention herein will have far reaching applications other than those of a flexible and oscillating appendage.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A device for propulsion as an oscillating appendage, said device comprising:

a vessel housing a supply of pressurized fluid;

a plurality of reinforced tubes in fluid communication with said vessel;

a valve for selectively controlling the supply of the pressurized fluid from said vessel to said reinforced tubes and release of the pressurized fluid from said reinforced tubes wherein the controlled supply and released flow of the pressurized fluid oscillates said oscillating appendage to propel said oscillating appendage; and a flexible skin encompassing said vessel, said reinforced tubes, and said valve wherein said flexible skin defines an outer shape of said oscillating appendage.

2. The device in accordance with claim 1 wherein said device further comprises a tail member at a terminal end of said oscillating appendage, said tail member reactive to the oscillating motion for additional propulsion.

3. The device in accordance with claim 2 wherein said valve comprises:

a casing having a plurality of ports formed therein for enabling the supply and release of the pressurized fluid in said reinforced tubes;

a spindle within said casing having passages formed therethrough, said passages aligning with selected ones of said plurality of ports; and opposing pressure chambers formed at opposite ends of said spindle, said pressure chambers controlling a position of said spindle between said pressure chambers;

wherein a first positioning of said spindle enables the supply of the pressurized fluid to one of said reinforced tubes axially expanding that said reinforced tube to bend said oscillating appendage in a direction toward another of said reinforced tubes during the release of the pressurized fluid from said another of said reinforced tubes thereby oscillating said oscillating appendage, and wherein a second positioning of said spindle reverses the enablement of the first positioning.

4. The device in accordance with claim 3 wherein said valve further includes an inner biased spring for normally biasing said spindle to the direction of the first positioning.

5. The device in accordance with claim 4 wherein each of said reinforced tubes includes inner elastomeric tubing and a plurality of surrounding axially arranged constraint rings for constraining radial expansion of said inner elastomeric tubing.

6. The device in accordance with claim 5 wherein said reinforced tubes are fluidly connected at intervals to each other.

7. The device in accordance with claim 6 wherein said fluid is compressible gas.

8. The device in accordance with claim 1 wherein said valve comprises:

a casing having a plurality of pores formed therein for enabling the supply and release of the pressurized fluid in said reinforced tubes;

a spindle within said casing having passages formed therethrough, said passages aligning with selected ones of said plurality of ports; and opposing pressure chambers formed at opposite ends of said spindle, said pressure chambers controlling a position of said spindle between said pressure chambers;

wherein a first positioning of said spindle enables the supply of the pressurized fluid to one of said reinforced tubes axially expanding that said reinforced tube to bend said oscillating appendage in a direction toward another of said reinforced tubes during the release of the pressurized fluid from said another of said reinforced tubes thereby oscillating said oscillating appendage, and wherein a second positioning of said spindle reverses the enablement of the first positioning.

9. The device in accordance with claim 8 wherein said valve further includes an inner biased spring for normally biasing said spindle to the direction of the first positioning.

10. The device in accordance with claim 9 wherein each of said reinforced tubes includes inner elastomeric tubing and a plurality of surrounding axially arranged constraint rings for constraining radial expansion of said inner elastomeric tubing.

11. The device in accordance with claim 10 wherein said reinforced tubes are fluidly connected at intervals to each other.

12. The device in accordance with claim 11 wherein said fluid is compressible gas.

13. A device for propulsion as an oscillating appendage, said device comprising:

a supply of pressurized fluid;

a plurality of reinforced tubes in fluid communication with said supply of pressurized fluid;

a means for directing said supply of pressurized fluid to a separate reinforced tube of said plurality of reinforced tubes;

a means for releasing in the same instant pressurized fluid from an alternate reinforced tube of said plurality of reinforced tubes thereby creating an oscillating motion by said oscillating appendage to propel said oscillating appendage; and a flexible skin encompassing said supply of pressurized fluid, said plurality of reinforced tubes, said directing means and said releasing means, said flexible skin responsive to said oscillating motion in propulsion of said device.

14. The device in accordance with claim 13 wherein said device further comprises a tail member at a terminal end of said oscillating appendage, said tail member reactive to the oscillating motion for additional propulsion.

* * * * *